US006075487A

United States Patent [19]

Ito

[11] Patent Number: 6,075,487

[45] Date of Patent: Jun. 13, 2000

[54] PORTABLE TELEPHONE AND ANTENNA DEVICE

[75] Inventor: Hiroki Ito, Kanagawa, Japan

[73] Assignee: Sony Corporation, Tokyo, Japan

[21] Appl. No.: 09/020,054

[22] Filed: Feb. 6, 1998

[30] Foreign Application Priority Data

Feb. 19, 1997 [JP] Japan ..... 9-034699

[51] Int. Cl.[7] ..... H01Q 1/24

[52] U.S. Cl. ..... 343/702; 343/901; 343/895

[58] Field of Search ..... 343/702, 900, 343/895, 901; H01Q 1/24

[56] References Cited

U.S. PATENT DOCUMENTS 5,739,792 4/1998 Hassemer et al. ..... 343/702

5,861,859 1/1999 Kanayama et al. ..... 343/895

5,867,127 2/1999 Black et al. ..... 343/702

*Primary Examiner*—Hoanganh Le

*Assistant Examiner*—Shih-Chao Chen

*Attorney, Agent, or Firm*—Jay H. Maioli

[57] ABSTRACT

Corresponding to a connector for an external antenna arranged at a bottom end portion of a housing of a portable telephone, a RF transmitter-receiver circuit and a feeding spring are provided in a lower part of a circuit substrate, electric power is supplied to a bottom end portion of a rod antenna longer than λ/4, and a supporting fitting arranged at a top end portion of the housing, for contacting the intermediate portion of the rod antenna is connected to a ground of the circuit substrate through a ground spring, whereby a portion of the rod antenna above the circuit substrate stably operates as a λ/4 mono-pole antenna.

9 Claims, 8 Drawing Sheets

PORTABLE TELEPHONE AND ANTENNA DEVICE

BACKGROUND OF THE INVENTION

1. Field of the Invention

The present invention relates to a portable wireless apparatus and an antenna device, suitable for a portable telephone in which the use in, for example, an automobile has been taken into consideration.

2. Description of Related Art

In recent years, portable telephones have become noticeably popular, but further miniaturization and weight reduction are being advanced in order to improve the portability, and antennas are also requested to be small-sized accordingly.

Conventionally, as an antenna for a portable telephone, there has been frequently used a disappearing whip antenna which is housed in the main body during carrying, and is drawn out from the main body during a call. This antenna is prevented from being damaged during carrying, and is convenient for carrying, while during a call, the influence of cut-off radio waves due to the human head is reduced by making the antenna length (height) large to improve the call quality.

On the other hand, in the case of using a portable telephone in an automobile, since sufficient sensitivity cannot be obtained only by a built-in antenna of the portable telephone surrounded by the metallic body, it is arranged such that sufficient sensitivity can be obtained even in the automobile by separately installing another antenna on the automotive window or on the outside of the body to connect the portable telephone to this external antenna. In this respect, when connected to the external antenna, the built-in antenna of the portable telephone is disconnected.

Such a portable telephone in which the use in an automobile has been taken into consideration as described above has been conventionally constructed as shown in, for example, FIG. 7 or FIG. 8.

In a portable telephone 10 shown in FIG. 7, a connector 12 for an external antenna is arranged facing an opening 11*b* at the bottom end portion of a housing 11 made of synthetic resin, and a circuit substrate 13 is housed inside the housing 11.

The connector 12 comprises a jack 12*j* in which a plug (not shown) connected to a feeding cable (not shown) for the external antenna is inserted, and a normally-closed switch 12*s* mechanically coupled to the jack 12*j*. In this respect, this connector 12 explains structure of the principle, and the present invention is not limited to such a connector type.

A RF transmitter-receiver circuit 14 packaged in the circuit substrate 13 is connected to the jack 12*j*, and is also connected to a feeding spring 17 arranged at the top end portion of the circuit substrate 13 through the normally-closed switch 12*s*, a feeding path 15 and a matching circuit 16.

On the upper surface of the housing 11, an opening is formed inside a convex ridge 11*a*, and a supporting fitting (holder) 22 for a rod antenna 21 is fitted in the opening so that the tip end portion of the feeding spring 17 elastically comes into contact with the outer surface of the holder 22. The rod antenna 21 is formed by a linear conductor, and its base is slidably supported by the holder 22 formed in a cylindrical shape.

In this respect, the length of the rod antenna 21 is set so that a portion above a contact point with the feeding spring 17 in a state in which the rod antenna 21 has been drawn out as shown in FIG. 7 is $\lambda/4$ ($\lambda$ is a wave length of the radio communication frequency band in length.

In such a portable telephone 10 in FIG. 7 as described above, when the plug for an external antenna is inserted into the jack 12*j* in the connector, the normally-closed switch 12*s* is opened to disconnect the rod antenna 21, and also the RF transmitter-receiver circuit 14 is connected to only the external antenna (not shown).

On the other hand, in a portable telephone 10C shown in FIG. 8, a connector 12C for an external antenna is arranged facing an opening 11*b* at the bottom end portion of a housing 11 made of synthetic resin, and a circuit substrate 13 is housed inside the housing 11.

The connector 12C comprises a jack 12*j* in which such a plug (not shown) for the external antenna as described above is inserted, and a sensor (not shown) for detecting the insertion of the plug into this jack 12*j*, and an output signal from this sensor is supplied to a control circuit 18 through a terminal 12*d*.

A RF transmitter-receiver circuit 14 packaged in the circuit substrate 13 is connected to the traveling contact of a change-over switch 19. This switch 19 is constituted by, for example, a field-effect transistor, and is change-over controlled through a control signal from the control circuit 18. A o-side fixed contact of the switch 19 is connected to the jack 12*j*, and an i-side fixed contact of the switch 19 is connected to a feeding spring 17 arranged at the top end portion of the circuit substrate 13 through the matching circuit 16.

On the upper surface of the housing 11, an opening is formed inside a convex ridge 11*a*, and a supporting fitting (holder) 22 for a rod antenna 21 is fitted in the opening so that the tip end portion of the feeding spring 17 elastically comes into contact with the outer surface of the holder 22. The rod antenna 21 is formed by a linear conductor, and its base is slidably supported by a holder 22 formed in a cylindrical shape.

In this respect, the length of the rod antenna 21 is set so that the portion above the contact point with the feeding spring 17 is $\lambda/4$ in length in a state in which the rod antenna 21 has been drawn out as shown in FIG. 8.

In such a portable telephone 10C in FIG. 8 as described above, when the plug for an external antenna is not inserted into the jack 12*j* in the connector 12C, the traveling contact of the change-over switch 19 is connected to the i-contact side as shown in FIG. 8 so that the RF transmitter-receiver circuit 14 is connected to only the rod antenna 21.

When the plug is inserted into the jack 12*j*, the traveling contact of the change-over switch 19 is changed over to the o-side of the change-over switch 19 contrary to the illustration so that the rod antenna 21 is disconnected and the RF transmitter-receiver circuit 14 is connected to only the external antenna (not shown).

In such a conventional portable telephone 10, 10C in which the use in an automobile has been taken into consideration as described above, the rod antenna 21 is arranged at the top end portion of the housing 11 in order to avoid the influence due to the human body during a call, and the feeding spring 17 is also provided at the top end portion of the circuit substrate 13 accordingly.

Also, the connector 12, 12C for the external antenna is provided at the bottom end portion of the housing 11 in order to reduce the cumbersomeness of the feeding cable during the use in an automobile.

In such a portable telephone 10 as shown in FIG. 7, however, since the RF transmitter-receiver circuit 14 arranged near the connector 12 is apart from the matching circuit 16 and the feeding spring 17, the feeding path 15, through which a RF signal is transmitted when the built-in antenna 21 is in use, becomes long so that the transmission loss due to this path 15 reaches, for example, about 1 dB.

In order to cover the transmission loss due to the feeding path 15, severe specifications are requested for the antenna system and the RF system circuit, and this has led to a problem that the manufacturing cost will be increased.

On the other hand, in such a portable telephone 10C as shown in FIG. 8, the feeding path when the built-in antenna 21 is in use can be shortened by the provision of an electronic change-over switch 19 in the vicinity of the RF transmitter-receiver circuit 14, but it has a problem that the manufacturing cost will be increased by the adoption of a connector 12C with a sensor and the change-over switch 19.

In light of the above-described points, an object of the present invention is to provide a portable wireless apparatus and an antenna device which have reduced the transmission loss between the RF transmitter-receiver circuit arranged in the vicinity of the external antenna connector and the built-in antenna.

SUMMARY OF THE INVENTION

In order to solve the above-described problem, a portable wireless apparatus according to the present invention is characterized in that in a portable wireless apparatus comprising an antenna conductor having an electrical length of not less than $\lambda/4$ in a state of the use, arranged so that a part of the antenna conductor is adjacent a circuit substrate in the state of the use, a portion of an electrical length of substantially $\lambda/4$ of the antenna conductor is rot adjacent the circuit substrate, but positioned upwardly from the top end side of the housing, a feeding unit for the antenna conductor is provided at a position of the circuit substrate on the bottom end side of the housing, and connecting means for connecting the antenna conductor to the ground of the circuit substrate is provided on the top end side of the housing.

According to a portable wireless apparatus of the present invention, constructed as described above, the feeding unit is provided on the bottom end side of the circuit substrate, namely, on the bottom end side of the housing, and electric power is also supplied to the antenna conductor on this bottom end side. Therefore, the transmission loss can be minimized.

And yet, the electrical length portion of substantially $\lambda/4$ of the antenna conductor is not adjacent the circuit substrate, but positioned above the top end side of the housing, and the antenna conductor is adapted to be connected to the ground of the circuit substrate on the top end side of the housing. Therefore, the electrical length portion of $\lambda/4$ works as a stable antenna portion to provide good antenna characteristics.

DETAILED DESCRIPTION OF PREFERRED EMBODIMENTS

Now, hereinafter, embodiments of a portable wireless apparatus according to the present invention will be described in conjunction with FIGS. 1 and 2.

Figure 1:
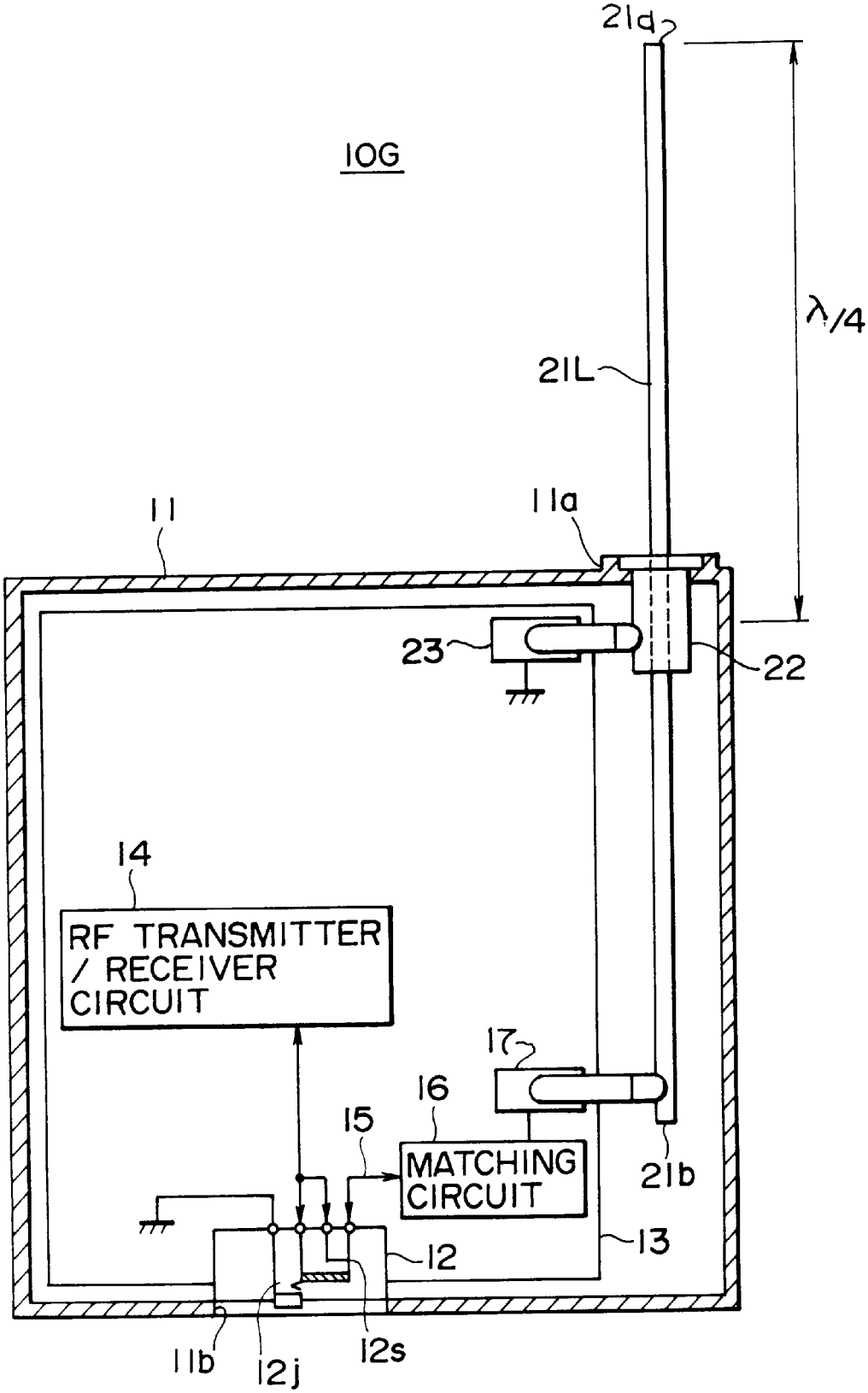
FIG. 1 is a conceptual view showing the structure of an embodiment of a portable wireless apparatus according to the present invention.
Figure 7:
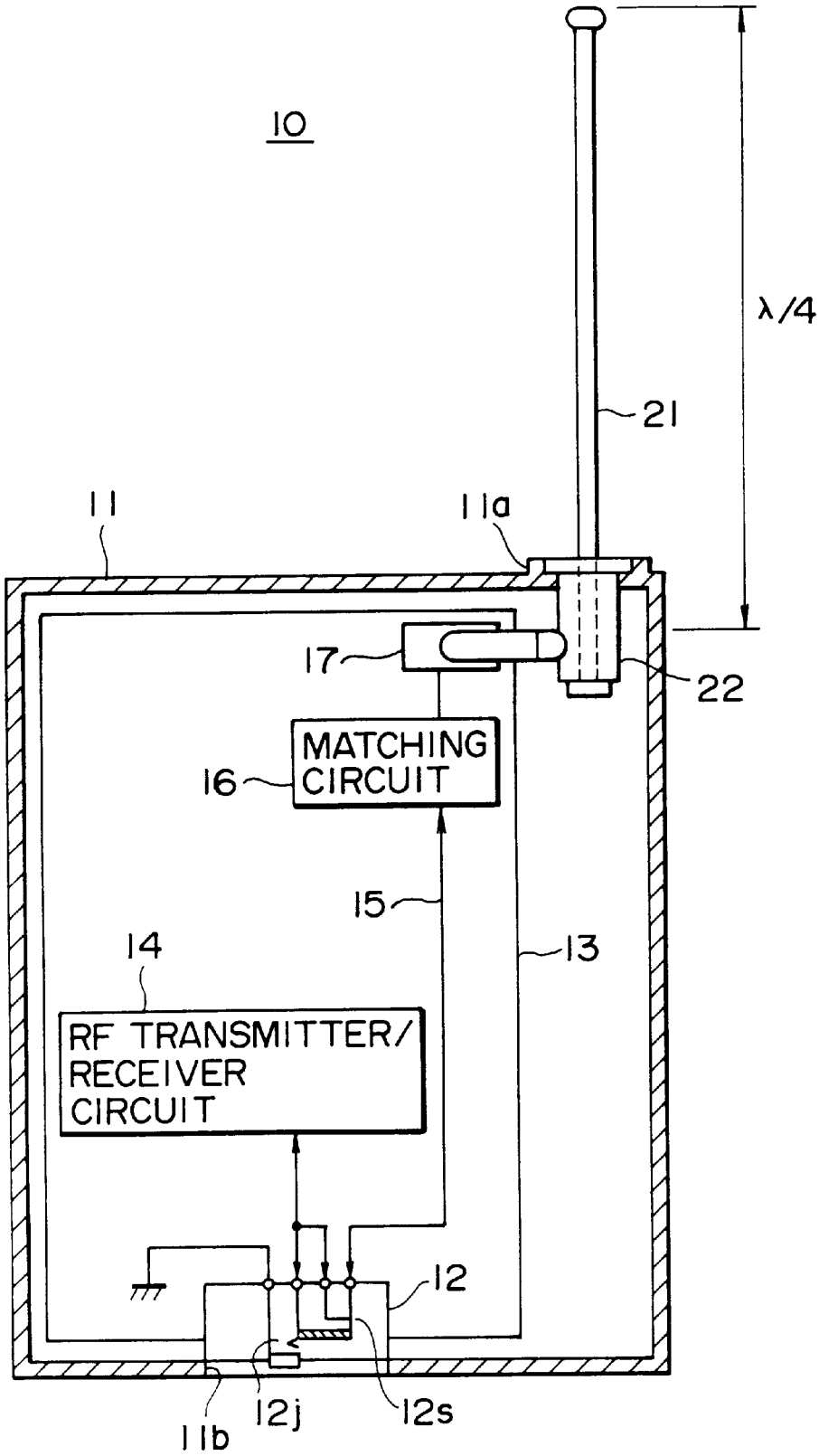
FIG. 7 (PRIOR ART)
FIG. 7 is a conceptual view showing the structural example of a conventional portable wireless apparatus.
Figure 8:
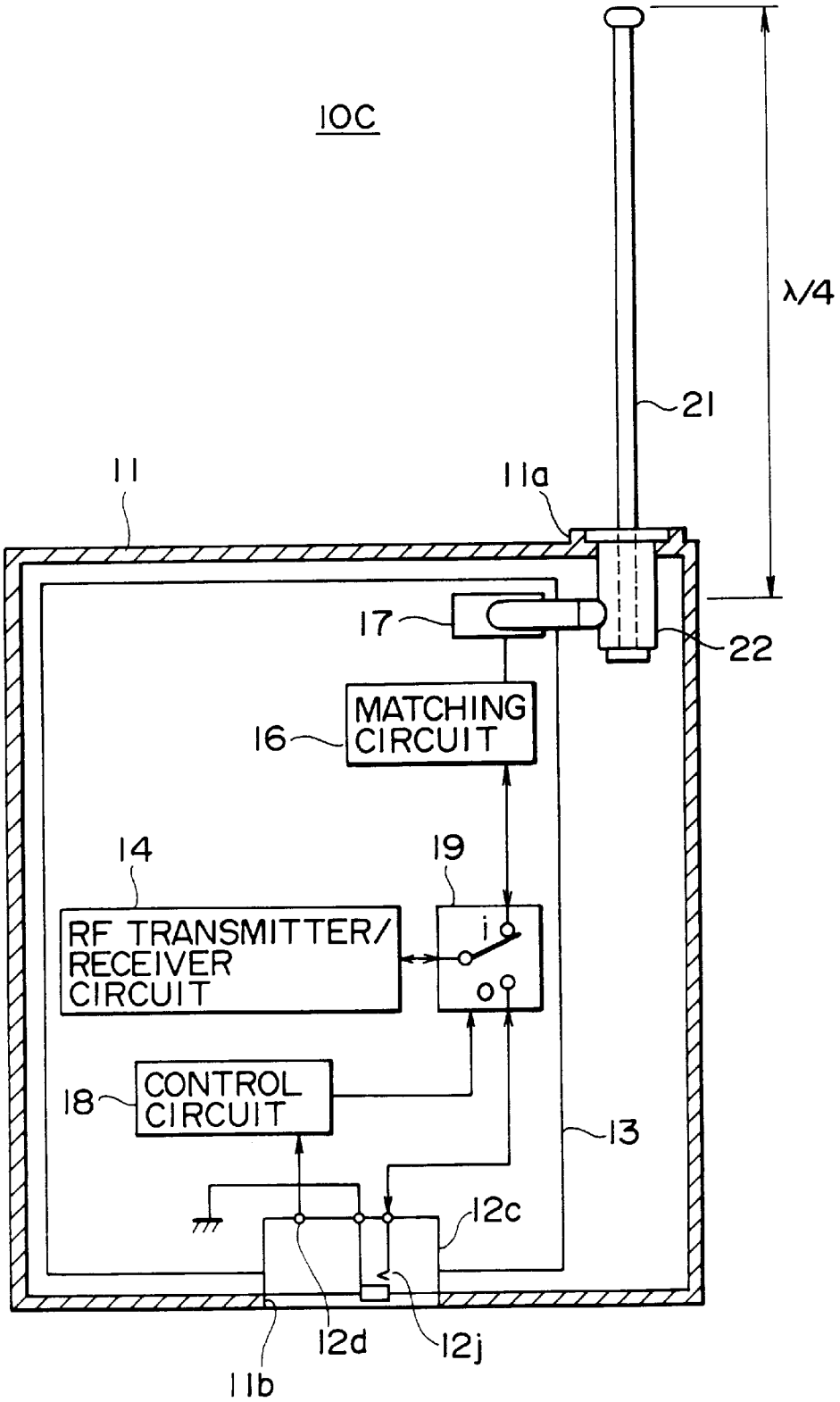
FIG. 8 (PRIOR ART)
FIG. 8 is a conceptual view showing another conventional example.

FIG. 1 shows the basic stricture of an example of a portable wireless apparatus according to the present invention. In FIG. 1, the members corresponding to those in FIG. 7 are referenced by the same reference marks to omit partial description.

In a portable telephone 10G shown in FIG. 1, a connector 12 for an external antenna is arranged facing an opening 11*b* at the bottom end portion of a housing 11 made of synthetic resin, and a circuit substrate 13 is housed inside the housing 11.

The connector 12 comprises a jack 12*j* in which a plug (not shown) connected to the feeding cable (not shown) for the external antenna is inserted, and a normally-closed switch 12*s* mechanically coupled to the jack 12*j*. In this respect, this connector 12 explains the structure of the principle as described above, and the present invention is not limited to such a connector type.

A RF transmitter-receiver circuit 14 packaged in the circuit substrate 13 is connected to the jack 12*j*, and is also connected to a feeding spring 17 through the normally-closed switch 12*s*, a feeding path 15 and a matching circuit 16.

In this example, the matching circuit 16 and the feeding spring 17 are arranged in the lower portion of the circuit substrate 13 in the vicinity of the connector 12 so that the feeding path 15 for connecting the normally-closed switch 12*s* to the matching circuit 16 becomes shorter than that in the conventional example shown in FIG. 7.

Also in this example, a second spring 23 is arranged at the top end portion of the circuit substrate 13, is connected to the ground thereof, and the tip end portion of this ground connected (grounded) spring 23 elastically comes into contact with the outer surface of a supporting fitting (holder) 22 fitted in an opening formed inside a convex ridge 11*a* on the upper surface of the housing 11.

In this example, in a rod antenna 21L made of linear conductive material longer than $\lambda/4$, its intermediate portion is supported by the holder 22, and the tip end portion of the feeding spring 17 elastically comes into contact with the bottom end portion 21*b* of the rod antenna 21L.

The length of the rod antenna 21L is set so that the portion above the contact point with the ground spring 23 becomes $\lambda/4$ in length in a state in which the bottom end portion 21*b* of the rod antenna 21L is in contact with the feeding spring 17 as shown in FIG. 1.

In addition, a spacing between the feeding spring 17 and the ground spring 23 is appropriately set but not at $\lambda/4$. This is because if the spacing between the two is set to be $\lambda/4$, the antenna impedance greatly varies when touching the portable telephone and when not touching it.

In such a portable telephone 10G as described above, when a plug for the external antenna is inserted into the jack 12*j* in the connector 12, the normally-closed switch 12*s* is opened to disconnect the rod antenna 21, and to connect the RF transmitter-receiver circuit 14 only to the external antenna (not shown).

When the plug for the external antenna is not inserted into the jack 12*j* in the connector 12, the RF transmitter-receiver circuit 14 is connected to the feeding spring 17 as described above to supply electric power to the bottom end portion 21*b* of the rod antenna 21L.

Figure 2A:
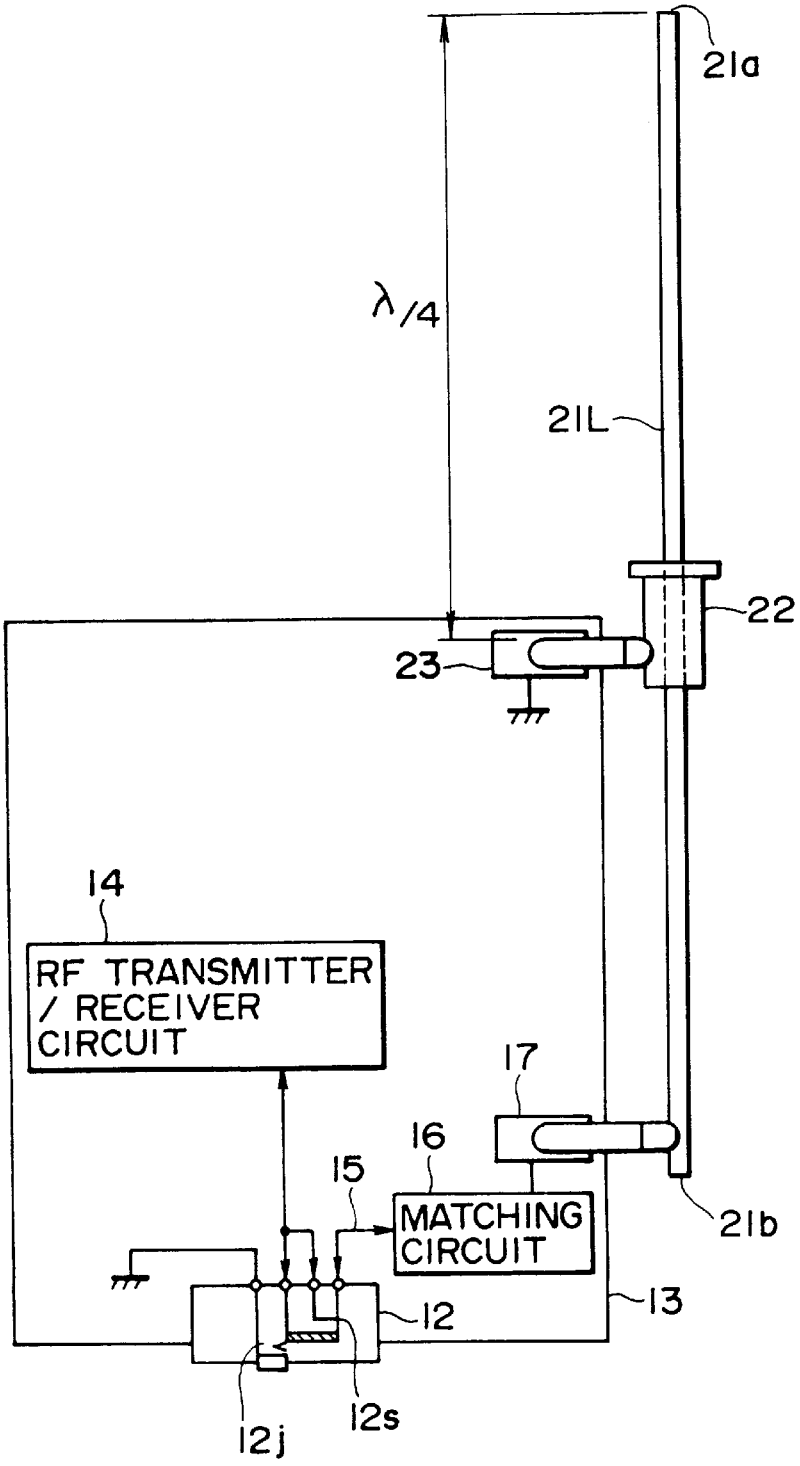
FIGS. 2A and 2B are conceptual views for explaining the excitation state of a principal part in an embodiment according to the present invention.
Figure 2B:
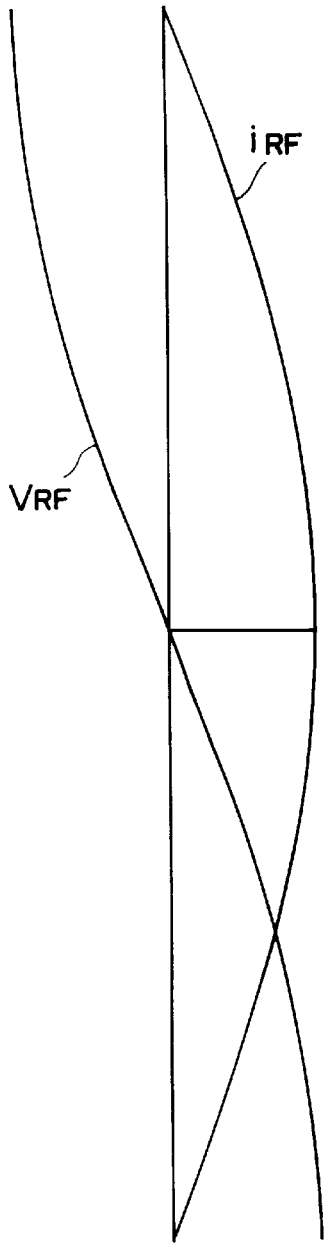

In this example, since the intermediate portion at a distance of λ/4 from the top end 21*a* of the rod antenna 21L is connected (grounded) to the ground of the circuit substrate 13 through the spring 23 as also shown in FIG. 2A, high frequency voltage VRF on the rod antenna 21L is distributed in a sine wave shape in which it is forcibly made to be "node" at the grounding point as shown by a fine line in FIG. 2B.

As a result, high frequency current iRF on the rod antenna 21L is distributed in a sine wave shape and is made to be "antinode" at the grounding point and made to be "node" at the top end 21*a* as shown by a solid line in FIG. 2B.

On the other hand, the high frequency voltage VRF and the high frequency current iRF in the portion below the grounding point of the rod antenna 21L are smoothly continuous at the grounding point substantially as shown in FIG. 2B, and the instability, as an antenna, of the portion below the grounding point of the rod antenna 21L is eliminated by its connection to the ground of the circuit substrate 13 through the spring 23.

In the above-described example, the matching circuit 16 and the feeding spring 17 are arranged in the lower part of the circuit substrate 13 in the vicinity of the connector 12, and electric power is supplied to the bottom end portion 21*b* of the rod antenna 21L longer than λ/4, whereby the feeding path 15 for connecting the normally-closed switch 12*s* to the matching circuit 16 can be made shorter than that of the conventional example shown in FIG. 7 to reduce the transmission loss.

Also, by connecting the intermediate portion of the rod antenna 21L to the ground of the circuit substrate 13 through the spring 23, it is possible to eliminate the instability, as an antenna, resulting from the portion below the grounding point of the rod antenna 21L.

The above-described embodiment in FIG. 1 shows the basic structure of the present invention, and is inconvenient for carrying in a state in which the upper part of the rod antenna 21L projects from the housing 11. Also, if an attempt is made to house the upper part of the rod antenna 21L in the housing 11, the antenna height will become small to greatly lower the gain.

In order to obviate such a problem, the rod antenna and a helical antenna with shorter shaft length are changed over for use. Another embodiment according to the present invention will be described with reference to FIGS. 3 and 4.

Figure 3:
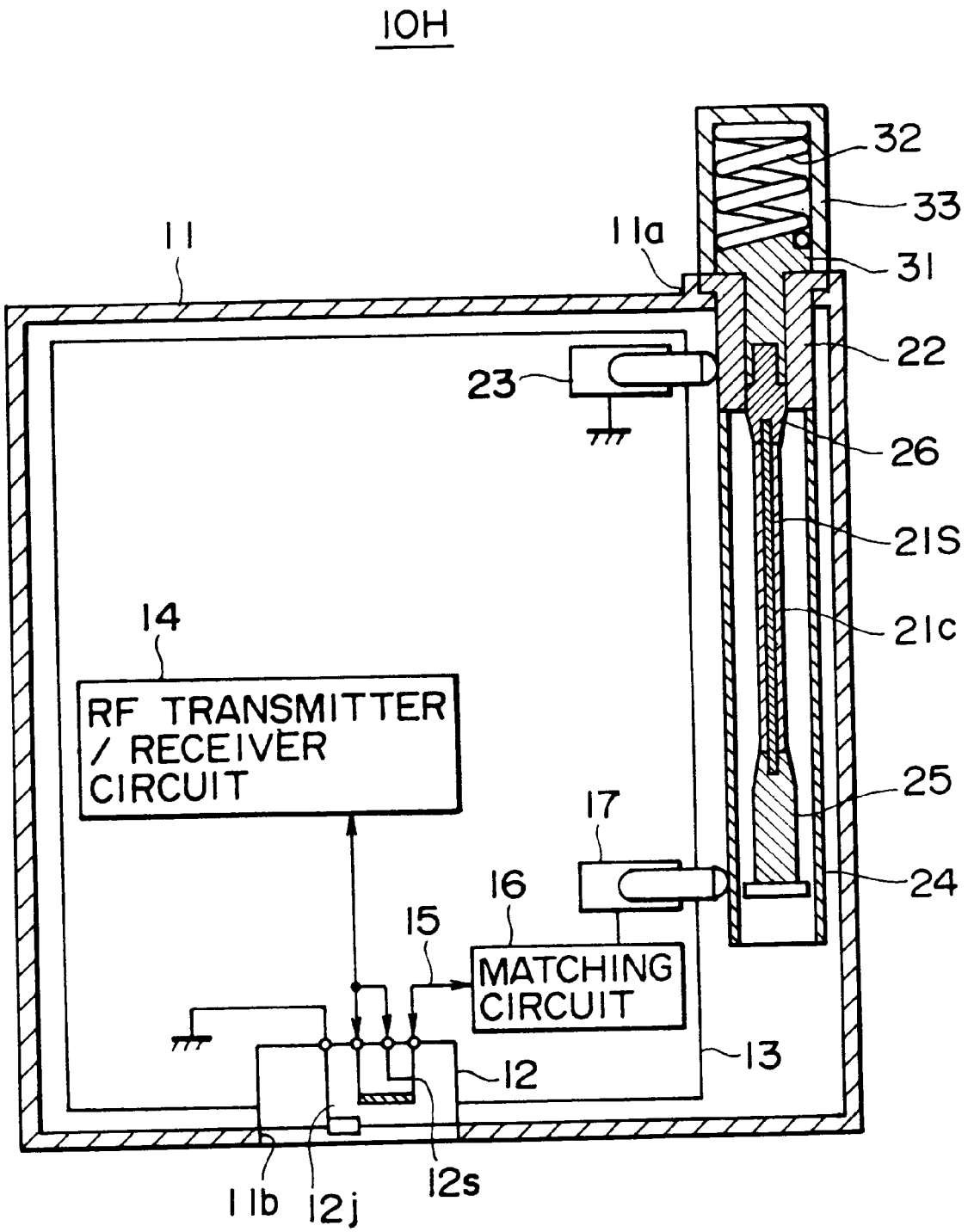
FIG. 3 is a cross-sectional view showing the structure of another embodiment according to the present invention.
Figure 4:
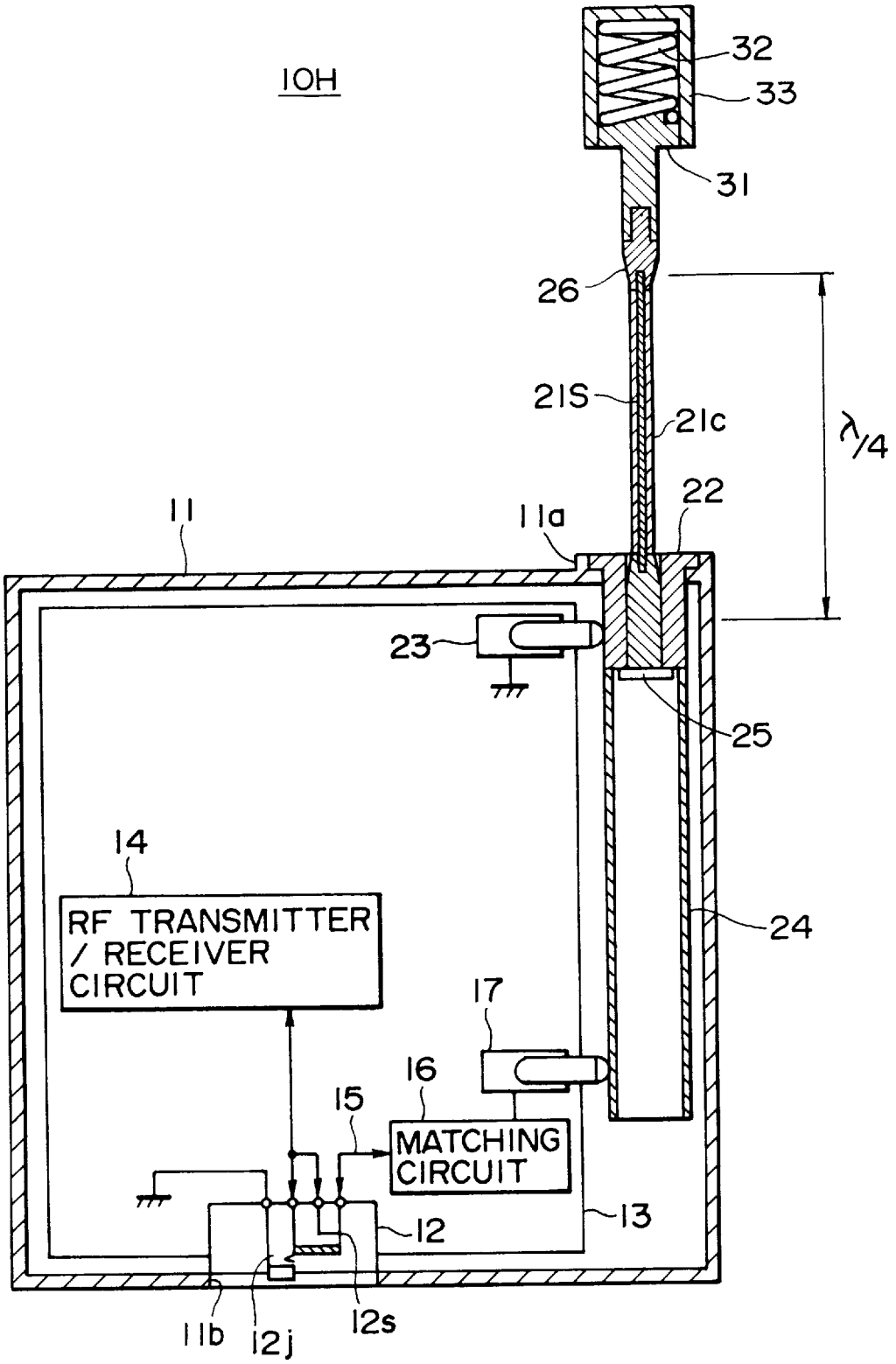
FIG. 4 is a cross-sectional view showing the structure of another embodiment according to the present invention.

The structure of another embodiment according to the present invention is shown in FIGS. 3 and 4. In these figures, the members corresponding to those in FIG. 1 and FIG. 7 are referenced by the same reference marks to omit partial description.

In the portable telephone 10H in FIGS. 3 and 4, a connector 12 for an external antenna is arranged facing an opening 11*b* at the bottom end portion of a housing 11 made of synthetic resin, and a circuit substrate 13 is housed inside the housing 11.

The connector 12 comprises a jack 12*j* in which a plug (not shown) connected to the feeding cable (not shown) for the external antenna is inserted, and a normally-closed switch 12*s* mechanically coupled to the jack 12*j*.

A RF transmitter-receiver circuit 14 packaged in the circuit substrate 13 is connected to the jack 12*j*, and is also connected to a feeding spring 17 through the normally-closed switch 12*s*, a feeding path 15 and a matching circuit 16.

As in the above-described example in FIG. 1, in this example, the matching circuit 16 and the feeding spring 17 are arranged in the lower part of the circuit substrate 13 in the vicinity of the connector 12, and the feeding path 15 for connecting the normally-closed switch 12*s* to the matching circuit 16 can be made shorter than that of the conventional example shown in FIG. 7.

Also in this example, a second spring 23 is arranged at the top end portion of the circuit substrate 13, is connected to the ground thereof, and the tip end portion of this ground connected (grounded) spring 23 elastically comes into contact with the outer surface of a supporting fitting (holder) 22 fitted in an opening formed inside a convex ridge 11*a* on the upper surface of the housing 11.

In this example, a cylindrical conductor 24 having a predetermined length is coaxially coupled to the bottom end of the holder 22, and the tip end portion of the feeding spring 17 elastically comes into contact with the outer surface of the bottom end portion of the cylindrical conductor 24.

Thereby, the RF transmitter-receiver circuit 14 and the holder 22 are electrically connected through the normally-closed switch 12*s*, the feeding path 15, the matching circuit 16, the feeding spring 17 and the cylindrical conductor 24.

Further, in this example, inside the cylindrical conductor 24, a rod antenna 21S made of a linear conductor is arranged coaxially therewith.

This rod antenna 21S is covered with an appropriate dielectric layer 21*c* over most of the electrical length of substantially λ/4, a columnar locking fitting (lower stopper) 25 is coupled to the bottom end of the rod antenna 21S, and a columnar coupling member 26 made of appropriate insulating material is mechanically coupled to the upper end portion of the rod antenna 21S.

On the upper side of the coupling member 26, a supporting and locking fitting (upper stopper) 31 having a "T" character-shape in cross section is coupled, and one end portion of a helical antenna 32 made of a spirally-formed conductor having an electrical length of substantially λ/4 is wound at the top end of the stopper 31 so that this helical antenna 32 and the rod antenna 21S are mechanically made integral. The helical antenna 32 is housed in a protective case 33 made of appropriate insulating material.

The upper and lower stoppers 31 and 25 are formed so as to be slidably supported by the holder 22 at their respective small-diameter portions. In this respect, a sliding spring appropriately constructed may be used although not shown.

In a state in which the rod antenna 21S has been housed in the housing 11 as shown in FIG. 3, the upper stopper 31 comes into contact with the top end of the holder 22 so that the helical antenna 32, the holder 22 and the cylindrical conductor 23 are electrically connected to operate as one antenna system.

In a state in which the rod antenna 21S has been drawn out from the housing 11 as shown in FIG. 4, the lower stopper 25 comes into contact with the bottom end of the holder 22 so that the rod antenna 21S, the lower stopper 25, the holder 22 and a cylindrical conductor 24 are electrically connected to operate as one antenna system.

Accordingly, in case the plug (not shown) connected to the feeding cable (not shown) of the external antenna is not inserted into the jack 12*j* in the connector 12, for example, in such a state as shown in FIG. 3, the RF transmitter-receiver circuit 14 and the helical antenna 32 are electrically connected through the normally-closed switch 12*s*, the feeding path 15, the matching circuit 16, the feeding spring 17, the cylindrical conductor 24 and the holder 22 as described above to enable reception through the helical antenna 32.

At this time, the rod antenna 21S is electrically disconnected from such a feeding system as described above by the coupling member 26, and does not function as an antenna.

Also, in such a state as shown in FIG. 4, the RF transmitter-receiver circuit 14 and the rod antenna 21S are electrically connected through the same feeding system as described above to enable a call through the rod antenna 21S.

At this time, the helical antenna 32 is electrically disconnected from such a feeding system as described above by the coupling member 26, and does not function as an antenna.

In each state of FIGS. 3 and 4, since the holder 22 is connected to the ground of the circuit substrate 13 through the spring 23 as described above, the helical antenna 32, which is above the holder 22, or the rod antenna 21S has the required gain with its electrical length stabilized at $\lambda/4$ and provides good characteristics as in the previously described embodiment.

In this respect, in this embodiment, the length of the rod antenna 21S is set so that the portion above the contact point with the ground spring 23 becomes $\lambda/4$ in length in a state in which the lower stopper 25 is aligned with the holder 22 as shown in FIG. 4.

Also, the spacing between the feeding spring 17 and the ground spring 23 is set but not at $\lambda/4$ for the above-described reason.

In the above-described embodiment, the matching circuit 16 and the feeding spring 17 are arranged in the lower part of the circuit substrate 13 in the vicinity of the connector 12, and electric power is supplied to the bottom end portion of the cylindrical conductor 24, whereby the feeding path 15 for connecting the normally-closed switch 12*s* to the matching circuit 16 can be made shorter than that of the conventional example shown in FIG. 7 to reduce the transmission loss.

In addition, the holder 22 is connected to the ground of the circuit substrate 13 through the spring 23 in such a manner that the electrical length of the antenna (32 or 21S) above the top end of the circuit substrate 13 becomes $\lambda/4$ either when the rod antenna 21S is housed or when it is drawn out, whereby it is possible to provide good antenna characteristics and to eliminate the instability, as an antenna, resulting from the cylindrical conductor 24 being below the grounding point of the holder 22.

Next, another embodiment according to the present invention will be described with reference to FIGS. 5 and 6.

Figure 5:
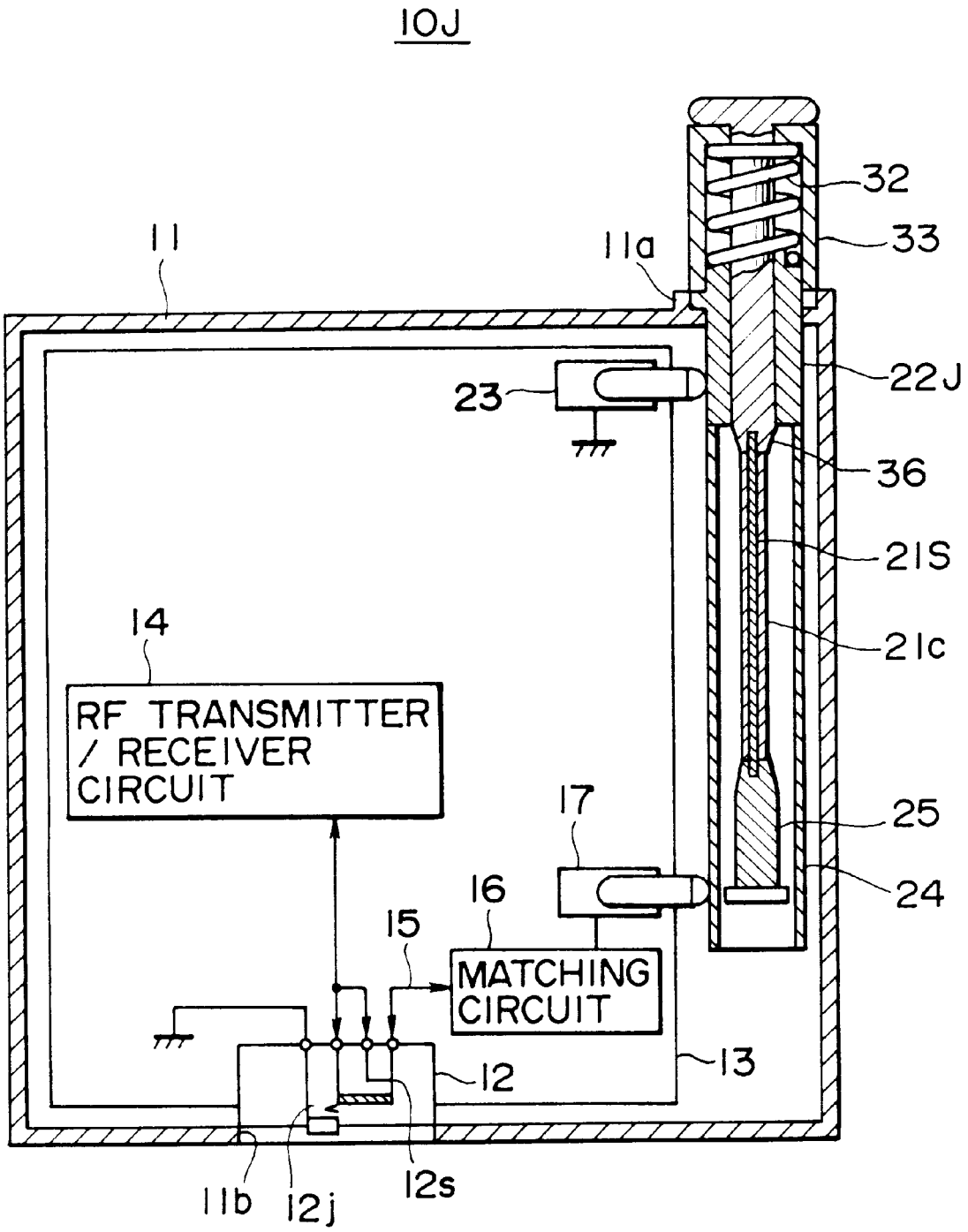
FIG. 5 is a cross-sectional view showing the structure of another embodiment according to the present invention.
Figure 6:
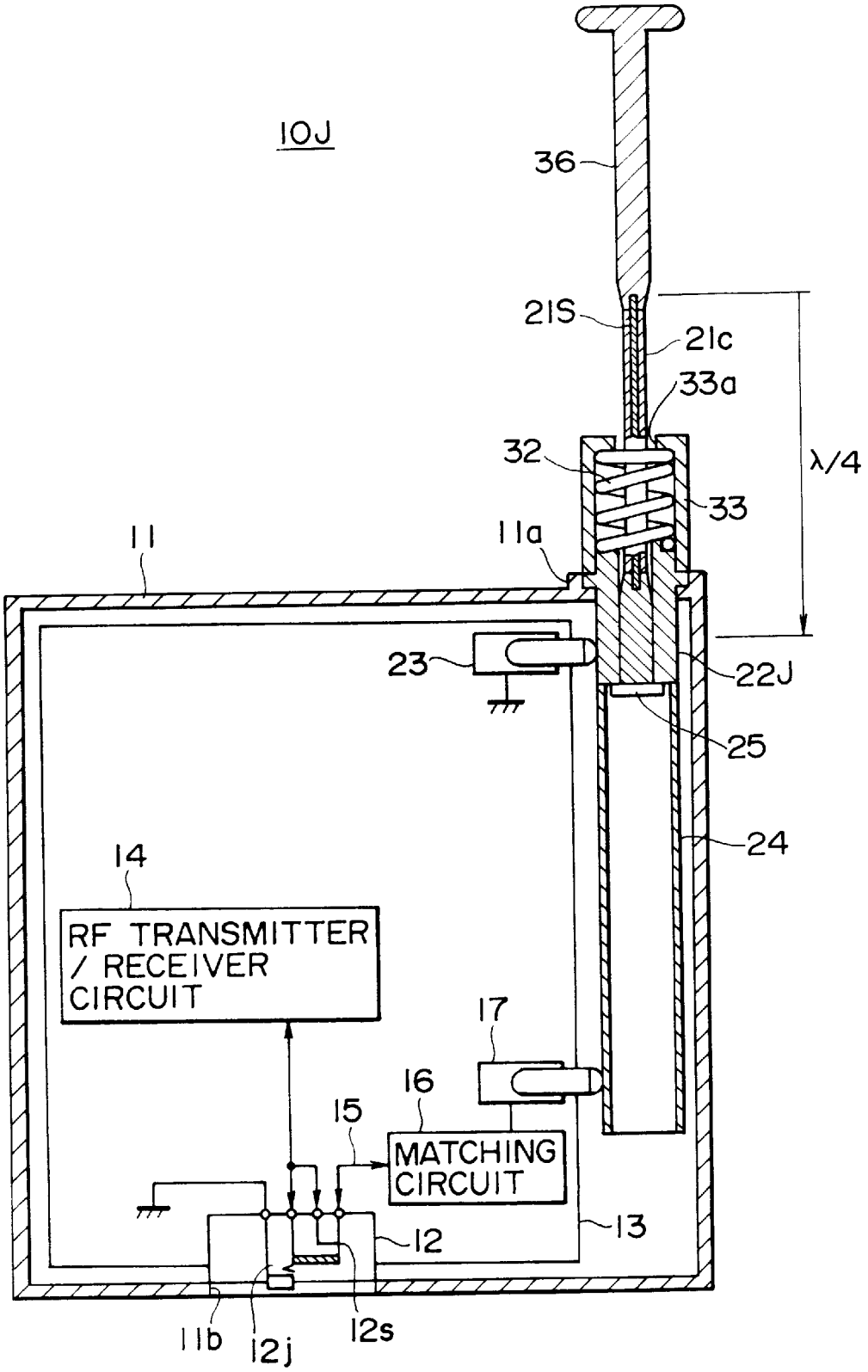
FIG. 6 is a cross-sectional view showing the structure of another embodiment according to the present invention.

The structure of another embodiment according to the present invention is shown in FIGS. 5 and 6. In these figures, the members corresponding to those in FIGS. 1 to 4 and FIG. 7 are referenced by the same reference marks to omit partial description.

In the portable telephone 10J in FIGS. 5 and 6, a connector 12 for an external antenna is arranged facing an opening 11*b* at the bottom end portion of a housing 11 made of synthetic resin, and a circuit substrate 13 is housed inside the housing 11.

The connector 12 comprises a jack 12*j* in which a plug (not shown) connected to the feeding cable (not shown) for the external antenna is inserted, and a normally-closed switch 12*s* mechanically coupled to the jack 12*j*.

A RF transmitter-receiver circuit 14 packaged in the circuit substrate 13 is connected to the jack 12*j*, and is also connected to a feeding spring 17 through the normally-closed switch 12*s*, a feeding path 15 and a matching circuit 16.

As in both embodiments described above, in this embodiment, the matching circuit 16 and the feeding spring 17 are arranged in the lower part of the circuit substrate 13 in the vicinity of the connector 12, and the feeding path 15 for connecting the normally-closed switch 12*s* to the matching circuit 16 is made shorter than that of the conventional example shown in FIG. 7.

Also in this embodiment, a second spring 23 is arranged at the top end portion of the circuit substrate 13, is connected to the ground thereof, and the tip end portion of this ground connected (grounded) spring 23 elastically comes into contact with the outer surface of a supporting fitting (holder) 22J fitted in an opening formed inside a convex ridge 11*a* on the upper surface of the housing 11.

A holder 22J of this embodiment is prepared by upwardly extending the holder 22 of the embodiment shown in FIGS. 3 and 4 and being wound by one end portion of a helical antenna 32 whose electrical length is substantially $\lambda/4$, and in this embodiment, the helical antenna 32 is mechanically fixed to the housing 11.

In this embodiment, a cylindrical conductor 24 having a predetermined length is coaxially coupled to the bottom end of a holder 22J, and the tip end portion of the feeding spring 17 elastically comes into contact with the outer surface of the bottom end portion of the cylindrical conductor 24.

Thereby, the RF transmitter-receiver circuit 14 and the holder 22J are electrically connected through the normally-closed switch 12*s*, the feeding path 15, the matching circuit 16, the feeding spring 17 and the cylindrical conductor 24.

Further, in this embodiment, a rod antenna 21S covered with an appropriate dielectric layer 21*c* over most of the electrical length of substantially $\lambda/4$ is arranged coaxially with the cylindrical conductor 24 inside it, a columnar locking fitting (lower stopper) 25 is coupled to the bottom end of the rod antenna 21S, and a thumb member (upper stopper) 36 also for locking, having a "T"-character shaped cross section, made of appropriate insulating material is coupled at the top end portion of the rod antenna 21S.

This stopper 36 is inserted into an opening 33*a* formed in the upper surface of a protective case 33 for the helical antenna 32 so that the top end portion of the stopper 36 comes into contact with the upper surface of the protective case 33 in a state in which the rod antenna 21S is housed in the housing 11 as shown in FIG. 5.

The upper and lower stoppers 36 and 25 are formed so as to be slidably supported by a holder 22J at their respective small-diameter portions. In this respect, an appropriately constructed sliding spring may be used though not shown.

In a state in which the rod antenna 21S has been housed in the housing 11 as shown in FIG. 5, when the top end portion of the upper stopper 36 comes into contact with the upper surface of the protective case 33, the helical antenna 32, the holder 22 and the cylindrical conductor 23 are electrically connected to operate as one antenna system. Also, in a state in which the rod antenna 21S has been drawn out from the housing 11 as shown in FIG. 6, the lower stopper 25 comes into contact with the bottom end of the holder 22J, whereby the rod antenna 21S, the lower stopper 25, the holder 22 and the cylindrical conductor 24 are electrically connected to operate as one antenna system. In this respect, the helical antenna 32 operates as an auxiliary antenna.

Accordingly, in case the plug (not shown) connected to the feeding cable (not shown) of the external antenna is not inserted into the jack 12*j* in the connector 12, for example, in such a state as shown in FIG. 5, the RF transmitter-receiver circuit 14 and the helical antenna 32 are electrically connected through the normally-closed switch 12*s*, the feeding path 15, the matching circuit 16, the feeding spring 17, the cylindrical conductor 24 and the holder 22J as described above to enable reception through the helical antenna 32.

At this time, the rod antenna 21S is electrically disconnected from such a feeding system as described above by the upper stopper 36, and does not function as an antenna.

Also, in such a state as shown in FIG. 6, the RF transmitter-receiver circuit 14 is electrically connected to the helical antenna 32 and the rod antenna 21S in common through the same feeding system as described above to enable a call mainly through the rod antenna 21S.

In each state of FIGS. 5 and 6, since the holder 22J is connected to the ground of the circuit substrate 13 through the spring 23 as described above, the helical antenna 32, which is above the holder 22J, or the rod antenna 21S has a required gain with its electrical length stabilized at $\lambda/4$ and provides good characteristics as in the previously described embodiment.

In this respect, in this example, the length of the rod antenna 21S is set so that the portion thereof above the contact point with the ground spring 23 becomes $\lambda/4$ in length in a state in which the lower stopper 25 is aligned with the holder 22J as shown in FIG. 6.

Also, the spacing between the feeding spring 17 and the ground spring 23 is set but not at $\lambda/4$ for the above-described reason.

In the above-described example, the matching circuit 16 and the feeding spring 17 are arranged in the lower part of the circuit substrate 13 in the vicinity of the connector 12, and electric power is supplied to the bottom end portion of the cylindrical conductor 24, whereby the feeding path 15 for connecting the normally-closed switch 12*s* to the matching circuit 16 can be made shorter than that of the conventional example shown in FIG. 7 to reduce the transmission loss.

In addition, the holder 22 is connected to the ground of the circuit substrate 13 through the spring 23 in such a manner that the electrical length of the antenna (32 or 21S) above the top end of the circuit substrate 13 becomes $\lambda/4$ either when the rod antenna 21S is housed or when it is drawn out, whereby it is possible to provide good antenna characteristics and to eliminate the instability, as an antenna, resulting from the cylindrical conductor 24 being below the grounding point of the holder 22.

In each of the embodiments described above, the description has been made of the cases in which the holders 22, 22J, the cylindrical conductor 24, the upper stopper 36 and the lower stopper 25 are constituted by metallic material, but the present invention is not limited thereto, and a similar effect can be obtained even if they are constituted by predetermined conductive material.

Also, in each of the embodiments described above, the description has been made of the case in which the RF transmitter-receiver circuit 14 is connected to the rod antenna 21S and the helical antenna 32, but the present invention is not limited thereto, and only the transmission circuit or the reception circuit may be connected if the rod antenna 21S or the helical antenna 32 is used for exclusive use in transmission or in reception.

Also, in each of the embodiments described above, the description has been made of the case in which the rod antenna 21S is simply formed by a linear conductor, but the present invention is not limited thereto, and it may be possible to prevent the antenna from being broken by forming the rod antenna by an elastic conductor, by forming it by a conductor prepared by closely winding spring material, or by forming it by a spirally-prepared conductor at a small diameter.

As described above, according to the present invention, the transmission loss between the high frequency circuit and the antenna can be reduced.

In addition, either when the built-in antenna is housed or when it is drawn out, it is possible to provide stable, good antenna characteristics.

What is claimed is:

1. A portable wireless apparatus, comprising:

a housing;

a circuit substrate extending substantially from a top end side to a bottom end side of said housing;

an antenna conductor having an electrical length greater than $\lambda/4$ in a state of use, wherein a part of said antenna conductor is arranged adjacent to said circuit substrate, and a portion of an electrical length of substantially $\lambda/4$ is positioned above said top end side of said housing;

a feeding unit for said antenna conductor provided on a first portion of said circuit substrate located on said bottom end side of said housing; and connecting means provided on a second portion of said circuit substrate located on said top end side of said housing for connecting said antenna conductor to a reference potential at said circuit substrate.

2. The portable wireless apparatus as set forth in claim 1, wherein a supporting conductor for supporting said antenna conductor is arranged at said top end side of said housing, and said connecting means connects said supporting conductor to said reference potential at said circuit substrate.

3. The portable wireless apparatus as set forth in claim 2, wherein said portion of said electrical length of substantially $\lambda/4$ of said antenna conductor is a linear conductor, and a remainder thereof is a cylindrical conductor coupled to said supporting conductor.

4. The portable wireless apparatus as set forth in claim 2, wherein said portion of said electrical length of substantially $\lambda/4$ of said antenna conductor is a spiral conductor, and a remainder thereof is a cylindrical conductor coupled to said supporting conductor.

5. A portable wireless apparatus, comprising:

a housing;

a circuit substrate extending substantially from a top end side to a bottom end side of said housing;

a feeding circuit provided at a bottom portion of said circuit substrate;

a hollow cylindrical conductor fixed in said housing, wherein a top end portion of said cylindrical conductor is connected to a reference potential provided at a top portion of said circuit substrate and a bottom end portion of said cylindrical conductor is connected to said feeding circuit provided at said bottom portion of said circuit substrate;

a linear antenna conductor having an electrical length of λ/4 slidably mounted inside said cylindrical conductor in an up-and-down direction and upwardly projectable from said top end portion of said cylindrical conductor; and a spiral antenna conductor having an electrical length of λ/4 electrically disconnected from said cylindrical conductor and placed above said linear antenna conductor for moving with a sliding movement of said linear antenna conductor in said up-and-down direction, wherein when said linear antenna conductor and said spiral antenna conductor are drawn out above said cylindrical conductor so that said electrical length of λ/4 of said linear antenna conductor is drawn out above said cylindrical conductor, bottom end portion of said linear antenna conductor and said top end portion of said cylindrical conductor are connected so that said linear antenna conductor and said cylindrical conductor operate as a mono-pole antenna and said spiral antenna conductor does not operate, and when said linear antenna conductor is housed in said cylindrical conductor, a bottom end portion of said spiral antenna conductor and said top end portion of said cylindrical conductor are connected so that said spiral antenna conductor and said cylindrical conductor operate as a mono-pole antenna and said linear antenna conductor does not operate.

6. A portable wireless apparatus, comprising:

a housing;

a circuit substrate extending substantially from a top end side to a bottom end side of said housing;

a feeding circuit provided at a bottom portion of said circuit substrate;

a hollow cylindrical conductor fixed in said housing, wherein a top end portion of said cylindrical conductor is connected to a reference potential provided at a top portion of said circuit substrate and a bottom end portion of said cylindrical conductor is connected to said feeding circuit provided at said bottom portion of said circuit substrate;

a linear antenna conductor having an electrical length of λ/4 slidably mounted inside said cylindrical conductor in an up-and-down direction and upwardly projectable from said top end portion of said cylindrical conductor; and a fixed spiral antenna conductor having an electrical length of λ/4 electrically connected at said top end portion of said cylindrical conductor, wherein when said linear antenna conductor is drawn out above said cylindrical conductor, a portion of said electrical length of λ/4 of said linear antenna conductor is drawn out above said cylindrical conductor so that a bottom end portion of said linear antenna conductor and said top end portion of said cylindrical conductor are connected and said linear antenna conductor and said cylindrical conductor operate as a mono-pole antenna and said fixed spiral antenna conductor operates as an auxiliary antenna, and when said linear antenna conductor is housed in said cylindrical conductor, said fixed spiral antenna conductor and said cylindrical conductor operate as a mono-pole antenna while said linear antenna conductor does not operate.

7. An antenna device, comprising:

a circuit substrate;

an antenna conductor having an electrical length greater than λ/4 in a state of use, wherein a part of said antenna conductor is arranged adjacent to said circuit substrate, and a portion of an electrical length of substantially λ/4 is positioned above a top end side of said circuit substrate;

a feeding unit for said antenna conductor provided on a first portion of said circuit substrate located on a bottom end side thereof; and connecting means provided on a second portion of said circuit substrate located on said top end side for connecting said antenna conductor to a reference potential at said circuit substrate.

8. An antenna device, comprising:

a housing;

a circuit substrate extending substantially from a top end side to a bottom end side of said housing;

a feeding circuit provided at a bottom portion of said circuit substrate;

a hollow cylindrical conductor fixed in a housing, wherein a top end portion of said cylindrical conductor is connected to a reference potential provided at a top portion of said circuit substrate and a bottom end portion of said cylindrical conductor is connected to said feeding circuit provided at said bottom portion of said circuit substrate;

a linear antenna conductor having an electrical length of λ/4 slidably mounted inside said cylindrical conductor in an up-and-down direction and upwardly projectable from said top end portion of said cylindrical conductor; and a spiral antenna conductor having an electrical length of λ/4 electrically disconnected from said cylindrical conductor and placed above said linear antenna conductor for moving as said linear antenna conductor slidingly moves in said up-and-down direction, wherein when said linear antenna conductor and said spiral antenna conductor are drawn out above said cylindrical conductor so that said electrical length of λ/4 of said linear antenna conductor is drawn out above said cylindrical conductor, a bottom end portion of said linear antenna conductor and said top end portion of said cylindrical conductor are connected so that said linear antenna conductor and said cylindrical conductor operate as a mono-pole antenna and said spiral antenna conductor does not operate, and when said linear antenna conductor is housed in said cylindrical conductor, a bottom end portion of said spiral antenna conductor and said top end portion of said cylindrical conductor are connected so that said spiral antenna conductor and said cylindrical conductor operate as a mono-pole antenna and said linear antenna conductor does not operate.

9. An antenna device, comprising:

a housing;

a circuit substrate extending substantially from a top end side to a bottom end side of said housing;

a feeding circuit provided at a bottom portion of said circuit substrate;

a cylindrical conductor fixed in said housing, wherein a top end portion of said cylindrical conductor is connected to a reference potential provided at a top portion of said circuit substrate and a bottom end portion of said cylindrical conductor is connected to said feeding circuit provided at said bottom portion of said circuit substrate;

a linear antenna conductor having an electrical length of $\lambda/4$ slidably mounted inside said cylindrical conductor in an up-and-down direction and upwardly projectable from said top end portion of said cylindrical conductor; and a fixed spiral antenna conductor having an electrical length of $\lambda/4$ electrically connected at said top end portion of said cylindrical conductor, wherein when said linear antenna conductor is drawn out above said cylindrical conductor, a portion of said electrical length of $\lambda/4$ of said linear antenna conductor is drawn out above said cylindrical conductor so that a bottom end portion of said linear antenna conductor and said top end portion of said cylindrical conductor are connected and said linear antenna conductor and said cylindrical conductor operate as a mono-pole antenna while said spiral antenna conductor operates as an auxiliary antenna, and when said linear antenna conductor is housed in said cylindrical conductor, said fixed spiral antenna conductor and said cylindrical conductor operate as a mono-pole antenna while said linear antenna conductor does not operate.

* * * * *